US006531253B2

(12) United States Patent
Ehara et al.

(10) Patent No.: US 6,531,253 B2
(45) Date of Patent: Mar. 11, 2003

(54) ELECTROPHOTOGRAPHIC PHOTOSENSITIVE MEMBER AND APPARATUS USING SAME

(75) Inventors: Toshiyuki Ehara, Kanagawa (JP); Koji Yamazaki, Kanagawa (JP); Masaya Kawada, Shizuoka (JP); Tetsuya Karaki, Shizuoka (JP); Hironori Ohwaki, Shizuoka (JP); Kunimasa Kawamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 09/819,759

(22) Filed: Mar. 29, 2001

(65) Prior Publication Data

US 2002/0018949 A1 Feb. 14, 2002

(30) Foreign Application Priority Data

Mar. 30, 2000 (JP) ..... 2000-095010

(51) Int. Cl.[7] ..... G03G 5/08

(52) U.S. Cl. ..... 430/66; 430/67; 430/69; 399/159

(58) Field of Search ..... 430/56, 57.4, 58.1, 430/66, 67, 69, 127, 132; 399/159

(56) References Cited

U.S. PATENT DOCUMENTS

| | | | | |
|---|---|---|---|---|
| 4,650,736 A | | 3/1987 | Saitoh et al. | 430/65 |
| 4,664,999 A | | 5/1987 | Kikinuma et al. | 430/67 |
| 4,705,733 A | | 11/1987 | Saitoh et al. | 430/69 |
| 4,735,883 A | | 4/1988 | Honda et al. | 430/69 |
| 4,795,691 A | | 1/1989 | Takei et al. | 430/67 |
| 4,952,473 A | * | 8/1990 | Suzuki | 430/56 |
| 6,128,456 A | | 10/2000 | Chigono et al. | 399/176 |
| 6,238,832 B1 | * | 5/2001 | Hashizume et al. | 430/67 |

FOREIGN PATENT DOCUMENTS

| | | |
|---|---|---|
| DE | 3435757 | 4/1985 |
| EP | 0508457 | 10/1992 |
| EP | 0872770 | 10/1998 |
| EP | 0926560 A1 * | 6/1999 |
| JP | 60168156 | 8/1985 |
| JP | 60178457 | 9/1985 |
| JP | 60225854 | 11/1985 |
| JP | 61231561 | 10/1986 |
| JP | 6118741 | 4/1994 |
| JP | 777702 | 3/1995 |
| JP | 112996 | 1/1999 |

OTHER PUBLICATIONS

Derwent Abstract Acc No. 1993–270304/*199334* for JP 93–049108, 7/03.

* cited by examiner

*Primary Examiner*—Janis L. Dote
(74) *Attorney, Agent, or Firm*—Fitzpatrick, Cella, Harper & Scinto

(57) ABSTRACT

An a-Si photosensitive member and an image forming apparatus are provided which prevent fusion bonding in digital copying machines and attain satisfactory image formation. Specifically, in order that even when uneven abrasion occurs on a drum surface layer, it may not substantially affect the image, a photosensitive member formed by successively stacking on a conductive substrate a photoconductive layer comprising amorphous Si and a surface protective layer comprised of an amorphous material is provided such that the spectral reflectance (%) satisfies the relation of $0 \leqq (Max-Min)/(Max+Min) \leqq 0.20$, and a center line average roughness Ra1 of the interface on the surface side of the photoconductive layer and the center line average roughness Ra2 of the outermost surface of the surface layer, within the range of 10 $\mu$m×10 $\mu$m, satisfy the relations of Ra1/Ra2≧1.3 and 22 nm≦Ra1≦100 nm.

11 Claims, 9 Drawing Sheets

(1 of 9 Drawing Sheet(s) Filed in Color)

ELECTROPHOTOGRAPHIC PHOTOSENSITIVE MEMBER AND APPARATUS USING SAME

BACKGROUND OF THE INVENTION

1. Field of the Invention

The present invention relates to an electrophotographic photosensitive member and an electrophotographic apparatus using such a member and, more particularly, to an electrophotographic photosensitive member and an electrophotographic apparatus which are not susceptible, or not readily susceptible, to unevenness in image density even when there arises uneven abrasion (non-uniform wearing).

2. Related Background Art

In an electrophotographic apparatus, such as a copying machine, a facsimile or a printer, the peripheral surface of a photosensitive member, on which a photoconductive layer is formed, is uniformly charged by charging means such as corona charging, roller charging, fur brush charging or magnetic brush charging; then an electrostatic latent image is formed on the peripheral surface of the photosensitive member by exposure of a copied image of an copying object with laser or LED light according to a reflected light or modulated signal; a toner image is formed by adhering a toner to the photosensitive member; and the toner image is transferred to a sheet of copying paper or the like to form a copied image.

After a copied image is formed in the electrophotographic apparatus in this manner, there remains on the peripheral surface of the photosensitive member a part of the toner, and the residual toner needs to be removed. Usually, the residual toner is removed by a cleaning step using a cleaning blade, a fur brush, a magnetic brush or the like.

In recent years, from the viewpoint of consideration for environment, there have been proposed and introduced to the market electrophotographic apparatuses in which the cleaning device is dispensed with to reduce or eliminate a waste toner. They include what is disclosed in the Japanese Patent Application Laid-Open No. 6-118741, in which a direct charger, such as a brush charger, also serves the cleaning purpose, and what is disclosed in the U.S. Pat. No. 6,128,456, in which a developer also takes charge of cleaning, but both involve a step in which the toner and the surface of the photosensitive member are worn to remove the toner.

However, the need for high level of picture quality of printed images in recent years has led to the use of a toner smaller in average grain size than what was previously used or a toner with a lower melting point that is compatible with energy conservation, and there has been occurred the phenomenon that such a toner will be fusion bonded to a surface of a photosensitive member. In a toner removing process for removing the toner at an initial stage of fusion bonding, there is a case where the increase of load imposed on the cleaning step generates uneven abrasion of a surface layer of a photosensitive member or where an unevenly located charging member remains in contact with a surface layer of a photosensitive member to generate uneven abrasion of the surface layer.

Thus, there has been a problem that irradiation with an image exposure light in such a condition will generate interference due to unevenness in the thickness of a surface layer, which in turn will give rise to a difference in quantity of light incident on a photoconductive layer to generate belt-like unevenness in a halftone image. Moreover, along with the increasing digitization of electrophotographic apparatuses in recent years, latent image formation with a light source mainly emitting a light of a single wavelength is becoming the main stream, which results in frequent occurrence of interference, thereby aggravating the problem.

With a view to solving this problem, as disclosed in the Japanese Patent Publication No. 5-49108 and U.S. Pat. No. 4,795,691, there are proposed methods to prevent the halftone image unevenness caused by unevenness in the quantity of incident light attributable to uneven abrasion of a surface layer by providing an intermediate layer between a photoconductive layer and a surface layer of a photosensitive member with a photosensitive layer of amorphous Si or by continuously varying the composition of the interface to thereby reduce or eliminate reflection at the interface.

Whereas recently introduced digital copying machines and printers use such a photosensitive member, they are often inadequate for preventing unevenness in halftone images arising from unevenness in film thickness of fine pitches, ranging from tens of $\mu$m to a few mm attributable to the aforementioned cleaner or contact charger. On the other hand, the configuration to continuously vary the interface composition to effect control so as to restrain interface reflection at that part, requires strict control of the manufacturing conditions to achieve steady production by reducing fluctuations in characteristics within and between individual photosensitive members and, moreover, involves such a delicate aspect that, where the composition of a photosensitive member has changed, the optimal continuous interface is determined by a balance of various characteristics.

Further, Japanese Patent Application Laid-Open No. 11-2996 proposes to polish a photosensitive member to regulate the surface roughness Rz to a predetermined value. However, no attention is paid to the occurrence or prevention of halftone image unevenness arising from unevenness in film thickness of fine pitches, ranging from tens of $\mu$m to a few mm attributable to a cleaner or contact charger.

Along with the increasing digitization of electrophotographic apparatuses in recent years, latent image formation with a light source mainly emitting a light of a single wavelength, such as a laser or an LED array, is becoming the main stream, but at the same time the speed of copying, i.e. the number of revolution of the photosensitive member, keeps on increasing along with the advancement of electric circuit elements. As a result, by merely relying on the method of reducing or eliminating reflection at the interface by provision of an intermediate layer between the photoconductive layer and the surface layer of a photosensitive member or continuously varying the composition of the interface, there arises a difference in the quantity of exposure light incident on the photoconductive layer, due to interference by the single wavelength light due to uneven abrasion of the surface layer, thereby sometimes generating a belt-like density difference in the printed image.

Further, the new addition of a step of previously roughing the surface of the conductive substrate will increase the production cost. Machining the substrate with such a roughness as to generate no density difference may pose a new problem of lowering in the image sharpness.

The present inventors have conducted extensive studies and found that the effect of preventing the belt-like (or linear) unevenness in a halftone image due to uneven abrasion of the surface layer is not determined merely by the control of the interface composition or the substrate roughness, but also greatly depends on the microscopic surface roughness (more specifically in the order of a few nm to tens of nm) peculiar to the surface of the a-Si (amorphous silicon) photosensitive member.

SUMMARY OF THE INVENTION

An object of the present invention, completed on the basis of the above described findings, is to provide a photosensitive member and an image forming apparatus that successfully ensure formation of a satisfactory image by preventing fusion bonding of a toner during cleaning.

According to the present invention, there is provided an electrophotographic photosensitive member formed by successively stacking on a conductive substrate a photoconductive layer comprising amorphous Si and a surface protective layer comprised of an amorphous material, wherein the minimum value (hereinafter referred to as Min) and the maximum value (hereinafter referred to as Max) of the reflectance (%) of the photosensitive member within the wavelength range of 600 nm to 700 nm satisfy the relation of $0 \leqq (Max-Min)/(Max+Min) \leqq 0.20$, and a center line average roughness Ra1 of the interface on the surface side of the photoconductive layer and a center line average roughness Ra2 of the outermost surface of the surface layer, within the range of 10 $\mu$m×10 $\mu$m, satisfy the relations of $Ra1/Ra2 \geqq 1.3$ and $22\ nm \leqq Ra1 \leqq 100\ nm$, and an electrophotographic apparatus having the electrophotographic photosensitive member.

The inventors have found that this makes possible to prevent a toner from fusion bonding to the surface of a photosensitive member to ensure formation of a satisfactory image, and succeeded in completing the present invention.

The term "microscopic surface roughness" as used herein refers to the value of surface roughness Ra measured by using an atomic force microscope (AFM) (trade name: Q-SCOPE 250 mfd. by Quesant). In order to measure microscopic surface roughness with high accuracy and good reproducibility, it is desirable to measure the roughness within the measuring range of 10 $\mu$m×10 $\mu$m in such a manner as to avoid any error due to the curvature tilt of the sample. To be more specific, this can be accomplished by parabolic correction whereby the curvature of the AFM image of the sample is fitted to a parabola in the tile removal mode of Quesant's Q-SCOPE 250 and then flattening is effected. This is an appropriate method because an electrophotographic photosensitive member usually has a cylindrical shape.

Further, if the image remains inclined, another procedure of correction (line by line) to remove the inclination is carried out. Thus, it is possible to appropriately correct any inclination of the sample within such a range as to generate no distortion of the data.

The term "center line average roughness Ra within a range of 10 $\mu$m×10 $\mu$m" as used herein refers to a value calculated from a three-dimensional shape by Quesant's atomic force microscope (AFM) Q-SCOPE 250 (Version 3.181).

When the present inventors calculated the two-dimensional center line average roughness Ra of a random sectional curve from a three-dimensional shape measured with the atomic force microscope, it was in substantial agreement with the centerline average roughness Ra within the range of 10 $\mu$m×10 $\mu$m calculated from the three-dimensional shape. However, the Ra value obtained from the three-dimensional shape is more desirable in terms of the stability of measurements and the mechanism of interference generation.

In the present invention, the means to establish the fine roughness relation $Ra1/Ra2 \geqq 1.3$ for disturbing the degree of parallelization of the surface layer includes not only the later described control of the film forming conditions for a photosensitive member or selection of the surface material but also, if necessary, further polishing to a desired level of fine roughness by the photosensitive member surface treating method such as described in Japanese Patent Publication No. 7-77702. More specifically, the conceivable method includes bringing a lapping tape available from Fuji Photo Film Co., Ltd., or 3M Co. into contact under pressures to a rotating photosensitive member to polish the surface thereof.

In particular, Ra1 is controlled by the degree of roughing by surface treatment of the substrate and the preparation conditions of the photoconductive layer, specifically, the ratio of source gases, gas flow rates, substrate temperature and discharge power. Ra2 is controlled by the preparation conditions of the surface layer, specifically, the ratio of source gases, gas flow rates, substrate temperature, discharge power and steps accompanied with surface polishing as an after-treatment or polishing in an electro-photographic apparatus.

<Fine Surface Roughness of Surface Side Interface of Photoconductive Layer and Outermost Surface of Surface Layer, and Degree of Parallelization of Surface Layer>

The fine degree of parallelization of the surface layer portion in the present invention will be described below.

An atomic force microscopy has a horizontal resolving power (resolving power in a direction parallel to the sample surface) finer than 0.5 nm and a vertical resolving power (resolving power in a direction perpendicular to the sample surface) of 0.01 to 0.02 nm, and is capable of measuring the three-dimensional shape of a sample. It is significantly distinguished from any surface roughness gauge, which is already in extensive use, in its high resolving powers.

Incidentally, in performing measurement with an AFM, the present inventors have measured a number of samples with a number of scanning sizes. The term "scanning size" is the length of a side of a square that is scanned. Therefore, a scanning size of 10 $\mu$m means scanning of a range of 10 $\mu$m×10 $\mu$m, i.e. 100 $\mu m^2$. A part of the measurement result is shown in FIG. 1, in which the horizontal axis of the graph represents the scanning size. FIG. 1 shows an example of the range of data obtained with a single scanning size.

When the scanning size is enlarged, i.e. the range of measurement is expanded, the measurements will become more stable, but the affection of the specific shapes such as waviness or projection of a sample substrate, or the machined shape will make it more difficult for the fine shape to be reflected, while a narrower angle of visibility increases fluctuations by selection of parts to be measured, so that the present invention has adopted the representation in terms of a 10 $\mu$m×10 $\mu$m field of view, which is synthetically excellent in the detection capacity of measurement and the stability. It should be understood from the above circumstances that the idea underlying the present invention is not limited to a 10 $\mu$m×10 $\mu$m field of view.

With so high resolving powers, it is possible to measure not just the roughness in an order where the roughness of the photosensitive member substrate is the dominant factor, but even such types of roughness attributable to the nature of deposited films themselves, such as a photoconductive layer, a surface layer, etc.

While the roughness of a photosensitive member substrate is dependent on "patterns", including the "treated member" and "tooth profile" such as what results from lathing, ball milling or dimpling, the roughness of a deposited film themselves has no pattern but involves complex profile factors.

One example of observed images is shown in FIG. 2. Details will be given afterwards with reference to Experiments and Examples of the invention.

Regarding the interference of the surface layer, the inventors have suspected that not only the parameter of the surface layer thickness in submicron order but also the parallelization of the surface layer, in which the very fine surface roughness of the surface side interface of the photoconductive layer and the outermost surface of the surface layer are reflected, may play a major part, and verified their suspicion through analysis.

More specifically, using a field emission type scanning electron microscope (FE-SEM) (Model S-4200 mfd. by Hitachi, Ltd.), samples were observed, which were subjected sectioning treatment with a focused ion beam (FIB) (FIB-200 type FIB apparatus mfd. by Fei Co.).

Examples of observed images are shown in FIGS. 3A through 3D and 4A through 4D.

The sample shown in FIG. 3A is an observed sectional image (×10000) of the surface layer portion in accordance with the present invention; FIG. 3B is an enlarged image (×50000) of a part near the boundary of the layers; FIGS. 3C and 3D are views more clearly illustrating the outline of the layers observed in FIGS. 3A and 3B, respectively. As is seen from FIGS. 3A through 3D, the roughness of the outermost surface of the surface layer, corresponding to the Ra2 value according to the invention, is smaller than the roughness of the surface side interface of the photoconductive layer corresponding to the Ra1 value according to the invention. In contrast thereto, in the samples shown in FIGS. 4A through 4D (drawn by following the same procedure as FIGS. 3A through 3D), the roughness of the outermost surface of the surface layer is approximately equal to that of the surface side interface of the photoconductive layer, i.e. substantially in parallel to the fine surface shape. Detailed comparison of numerical values will be made afterwards with reference to Experiments and Examples of the invention.

<Relationship between Surface Layer Thickness and Sensitivity>

It is preferable that the surface spectral reflectance of the aforementioned photosensitive member satisfies the conditions represented by the following equations.

For Min and Max of the reflectance (%) within the wavelength range of 600 nm to 700 nm:

$0 \leqq (Max-Min)/(Max+Min) \leqq 0.20$ more preferably, $0 \leqq (Max-Min)/(Max+Min) \leqq 0.10$ still more preferably, $0 \leqq (Max-Min)/(Max+Min) \leqq 0.05$ Herein, the term "reflectance" as used herein refers to a reflectance (percentage) measured with a spectrophotometer (trade name: MCPD-2000 mfd. by Otsuka Denshi Co.). To outline the measuring process, first the spectral emission intensity I(O) of the light source of the spectrophotometer is measured, then the spectral reflectance intensity I(D) of the photosensitive member is measured, and the reflectance R=I(D)/I(O) is calculated. For accurate measurement with good reproducibility, it is desirable to fix the detector with a jig so as to keep a constant angle relative to the photosensitive member having a certain curvature.

Specific examples of control of degree of parallelization are shown in FIGS. 5A and 5B. FIG. 5A shows a wavelength range of 400 to 720 nm, and FIG. 5B, a wavelength range of 600 to 700 nm. The data are the same for both diagrams. Data A and B are examples in which the degree of parallelization (or the property to be equidistant from each other) between the (photoconductive layer)/(surface layer) interface and the outermost surface is good, while data C, D and E are examples in which the degree of parallelization between the (photoconductive layer)/(surface layer) interface and the outermost surface is disturbed.

It is to be further noted that data A, B and C are examples outside the scope of the present invention.

The presence of two lines of data A and B is due to a difference in the film thickness of the surface protective layer, and the waveforms shift laterally on the graph depending on the difference in film thickness. As their maximum values correspond to the amplitudes of waveforms, those which show good degree of parallelization between the (photoconductive layer)/(surface layer) interface and the outermost surface, as viewed when fixed in a single wavelength, vary more greatly in reflectance than those which show disturbed degree of parallelization, with variation of the film thickness. That is, there arise a great variation in sensitivity along with the variation in the film thickness.

On the other hand, for data C, D and E, since Ra2 is changed to disturb the degree of parallelization between the (photoconductive layer)/(surface layer) interface and the outermost surface, the variation is significantly small.

Furthermore, in data D and E, which are examples of the present invention, the variations are almost negligible, and even when uneven abrasion of the surface layer of the photosensitive member arises in the cleaning step or an unevenly located charging member remains in contact with the surface layer of the photosensitive member to generate uneven abrasion of the surface layer, it is possible to prevent occurrence of an image unevenness.

<Relationship between Uneven Abrasion of Surface Layer and Unevenness in Halftone Image Density>

On the basis of the aforementioned result of the analysis and the electrophotographic evaluation, the mechanism of occurrence of unevenness in halftone image density and that of the effect of the present invention will now be described with reference to FIGS. 6A and 6B.

As described so far, Ra1 and Ra2 are substantially equal on the surface of an a-Si photosensitive member because of its production method, with the result that the surface layer thickness is constant from part to part, i.e. the surface is substantially parallel to the interface between the surface layer and the photoconductive layer. Since a light incident on the surface is reflected by the interface between the surface layer and the photoconductive layer and interferes with a light reflected from the surface, the quantity of incident light will be determined by the thickness of the surface layer according to the principles of interference. That is, a difference in the film thickness provides a difference in the electric potential, which is reflected in the image. This was as explained with reference to FIGS. 5A and 5B.

In practice, a portion of uneven abrasion will be generated in the surface layer as illustrated in FIG. 6A, and in whatever form the uneven abrasion may arise, the conditions for interference are met at least in a portion other than the uneven abrasion portion, so that the difference in the quantity of incident light at that portion differ from that at the uneven abrasion portion, thus giving rise to image unevenness.

However, in a photosensitive member as shown in FIG. 6B wherein the relationship between the photoconductive layer and the surface layer is Ra1/Ra2≧1.3, more preferably Ra1/Ra2≧1.5, and still more preferably Ra1/Ra2≧2.0, the conditions for interference are not met, and the electric potential does not depend on the thickness of the surface layer. Incidentally, by setting Ra1 to 22 nm or more, more preferably 30 nm or more, occurrence of interference can be prevented, and occurrence at such a portion of any flaw or linear abrasion that might be reflected in the image can also be prevented.

Controlling Ra2 by appropriately setting the conditions of surface layer formation or by proper after-treatment to achieve a relationship of Ra1/Ra2<1 also has an effect to disturb the degree of parallelization, but the conditions for interference may come to be met during use because of decrease of Ra2 by endurance printing, it is preferable to manufacture the product within the range where the conditions for interference can never be met from the outset, i.e. Ra1/Ra2≧1.3, more preferably Ra1/Ra2≧1.5, or still more preferably Ra1/Ra2≧1.8.

When Ra1 is to be controlled by machining the substrate, the substrate face and the surface also become approximately parallel to each other, the interference between them is not negligible. Since the photoconductive layer is highly absorbent unlike the surface layer, in order not to allow a light reflected by the substrate from interfering with a light reflected by the surface, it is preferable to select the photoconductive layer thickness or the light wavelength so as to provide sufficient light absorption so that the lights reflected from the substrate may not return to the surface.

Although depending on the exposure light wavelength and the absorption coefficient of the photoconductive layer, within the exposure light wavelength range which now constitutes the main stream, interference between the substrate and the Ra1 face can be prevented by setting the film thickness to 14 μm or more, more preferably 20 μm.

On the other hand, by setting the film thickness to 50 μm or less, Ra1 is made more controllable, and the peeling off of the film, increase of image defects and increase of production cost, that might arise where control is difficult, can be prevented from occurring.

Therefore, the film thickness of the photoconductive layer of the aforementioned photosensitive member is preferably 14 to 50 μm, more preferably 20 to 50 μm.

For the microscopic surface roughness in the present invention, the aforementioned Ra value of surface roughness measured using an atomic force microscope (AFM) (trade name: Q-SCOPE 250 mfd. by Quesant) is easier to handle, and, in order to measure the microscopic surface roughness with high accuracy and good reproducibility, it is desirable to measure the roughness within the range of 10 μm×10 μm. Further, in order to measure Ra1 of a photosensitive member having layers including the surface layer formed therein, there also is available an alternative method by which a calibration curve is prepared from the relationship between surface roughness obtained by observing a section of the photosensitive member with FE-SEM, TEM or the like and surface roughness obtained with AFM, and Ra2 is substituted with the roughness up to the photoconductive layer obtained by sectional observation.

BRIEF DESCRIPTION OF THE DRAWINGS

The file of this patent contains at least one drawing executed in color. Copies of this patent with color drawings will be provided by the Patent and Trademark Office upon request and payment of the necessary fee.

DETAILED DESCRIPTION OF THE PREFERRED EMBODIMENT

The present invention will be described in detail below with reference to accompanying drawings as needed.

<a-Si Photosensitive Member According to the Invention>

FIGS. 7A through 7D each show an example of electrophotographic photosensitive member according to the invention.

Figure 7A:
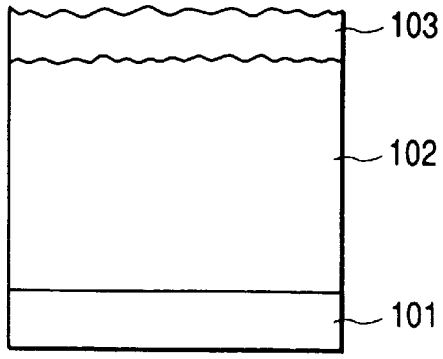
FIGS. 7A, 7B, 7C and 7D are schematic sectional views each illustrating an example of the layered configuration of an electrophotographic photosensitive member.
Figure 7B:
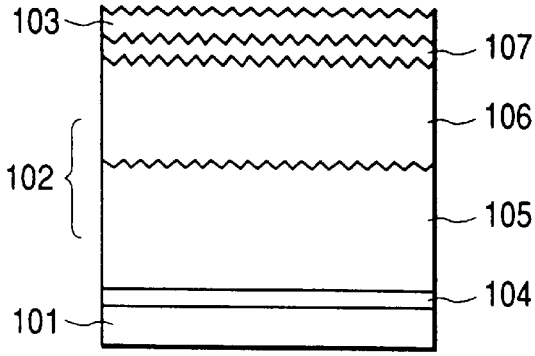

The example of the electrophotographic photosensitive member is configured by successively stacking a photoconductive layer 102 and a surface protective layer 103 on a substrate 101 made of a conductive material, such as aluminum (Al) or stainless steel (FIG. 7A). Besides these layers, various other layers may also be provided as required, including a lower blocking layer 104 and an upper blocking layer 107. For instance, by providing a lower blocking layer 104, an upper blocking layer 107 and so forth and selecting as their dopants an element of Group 13 of the Periodic Table, Group 15 of the Periodic Table and so forth, it becomes possible to control the polarity of charge to achieve positive charging or negative charging.

As the dopant, atoms of Group 13 giving p-type conductivity can be used for positive charging and, more specifically, boron (B), aluminum (Al), gallium (Ga), indium (In), thallium (Tl) and so forth constitute the available choice, of which B, Al or Ga are preferable. For negative charging, atoms of Group 15 giving n-type conductivity can be used. More specifically, phosphorus (P), arsenic (As), antimony (Sb), bismuth (Bi) and so on are available to choose from, of which P or As are preferable.

The content of the atoms for controlling the conductivity type is preferably $1\times10^{-2}$ to $1\times10^{4}$ atomic ppm, more preferably $5\times10^{-2}$ to $5\times10^{3}$ atomic ppm, and optimally $1\times10^{1}$ to $1\times10^{3}$ atomic ppm.

To structurally introduce the atoms for controlling the conductivity type, for example the atoms of Group 13 or Group 15, a source material for introducing atoms of Group 13 or a source material for introducing atoms of Group 15, in a gaseous state may be introduced during layer formation into a reaction vessel together with other gases for the formation of the photoconductive layer. As the source material for introducing atoms of Group 13 or atoms of Group 15, there are preferably adopted those which are gaseous at ordinary temperature and under ordinary pressure, or those which are readily gasifiable under the conditions of layer formation.

The source material for introducing atoms of Group 13 specifically includes boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. for introducing boron atoms. Other available materials for this purpose include $AlCl_3$, $GaCl_3$, $Ga(CH_3)_3$, $InCl_3$, $TlCl_3$, etc.

The substance that can be effectively used as a source material for introducing atoms of Group 15 preferably includes phosphorus hydrides such as $PH_3$, $P_2H_4$, etc. and phosphorus halides such as $PH_4I$, $PF_3$, $PF_5$, $PCl_3$, $PCl_5$, $PBr_3$, $PBr_5$, $PI_3$, etc. for introducing phosphorus atoms. Other available materials for introducing atoms of Group 15 include $AsH_3$, $AsF_3$, $AsCl_3$, $AsBr_3$, $AsF_5$, $SbH_3$, $SbF_3$, $SbF_5$, SbCl3, $SbCl_5$, $BiH_3$, $BiCl_3$, $BiBr_3$, etc.

The conductive substrate can be selected out of metals including Al, Cr, Mo, Au, In, Nb, Te, V, Ti, Pt, Pd, Fe, etc. and alloys thereof, such as stainless steel, of which Al is particularly preferable by reason of cost, weight and machinability. Further, the substrate may as well be an electrically insulating substrate of a film or sheet of a synthetic resin such as polyester, polyethylene, polycarbonate, cellulose acetate, polypropylene, polyvinyl chloride, polystyrene, polyamide, etc. or of glass, ceramic, or the like at least a surface on the photosensitive layer formed side of which is treated to have conductivity. The conductive material to be vapor-deposited is preferably Al or Cr in view of the ease in forming an ohmic junction with the photosensitive layer.

The shape of the substrate may be one of a cylinder or a planar endless belt having either a smooth or uneven surface, and its thickness may be determined suitably for forming a desired photosensitive member for an image forming apparatus, though the substrate is usually required to be 10 $\mu$m or more in thickness for manufacturing and handling convenience by reason of mechanical strength and other factors.

Figure 7C:
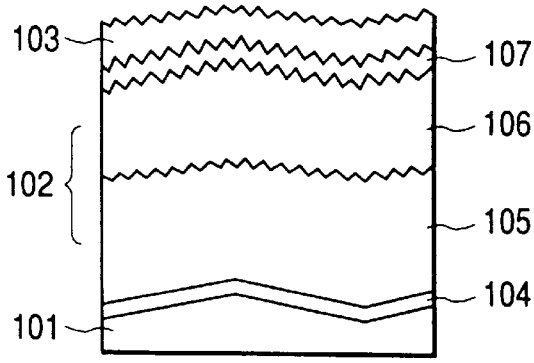
Figure 7D:
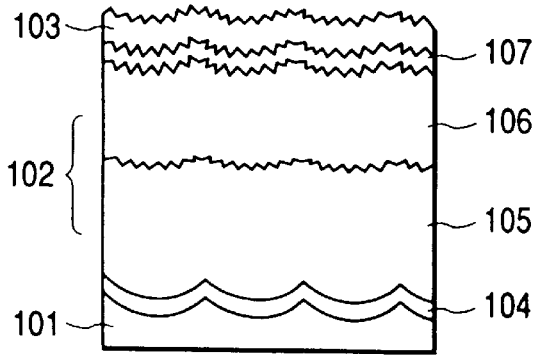

Especially where an image is to be recorded by using a coherent light, such as a laser light, the substrate surface may be provided with unevenness within such a range as to involve no decrease of photogenerated carriers so that image defects due to the so-called interference fringes, which appear in visible images, can be more effectively eliminated. The unevenness provided on the substrate surface can be created by any of known methods described in, among others, Japanese Patent Application Laid-Open Nos. 60-168156, 60-178457, 60-225854 and 61-231561. An example of section of mountain-shaped unevenness of the surface of the substrate 101 is shown in FIG. 7C, and one of dimple-shaped unevenness in FIG. 7D.

It is also possible to control the fine roughness of the photosensitive member surface by finely scratching the substrate surface. The scratching may be made using any one of an abrasive, chemical etching, so-called dry etching in plasma, sputtering or any other appropriate method. At this time, it is sufficient that the depth and size of scratches are within such a range as to involve no decrease of photogenerated carriers.

The photoconductive layer 102 may be of any photoconductive material, whether organic or inorganic. Typical inorganic photoconductive materials include an amorphous material, containing, e.g., silicon atoms and hydrogen atoms or halogen atoms (abbreviated as a-Si(H, X)), a-Se or the like of which a-Si(H, X) is preferable because of its stability and non-polluting nature.

Further, the film thickness of the photoconductive layer 102, though there is no particular restriction, is suitably 14 to 50 $\mu$m in view of the aforementioned reasons and manufacturing cost, and more preferably 20 to 50 $\mu$m.

Furthermore, to improve the characteristics, the photoconductive layer may be configured of a plurality of layers like a lower photoconductive layer 105 and an upper photoconductive layer 106. Especially for a light source whose wavelength is relatively long and hardly fluctuates, like a semiconductor laser, a dramatic effect can result from such a multi-layered configuration.

The surface protective layer 103, usually formed of a-SiC (H, X), may as well be formed of a-C(H, X). When halogen atoms are to be incorporated, a-SiC(H, F) or a-C(H, F) is preferable in respect of hardness and surface properties.

It is also possible and effective to continuously vary the interface compositions of the photoconductive layer 102 and the surface protective layer 103 to effect control so as to suppress interface reflection at that portion, but this would require strict control of the manufacturing conditions to ensure stability of photosensitive member characteristics both within and between individual members. In this regard, continuous variation of the interface composition is not an indispensable aspect of the configure if the condition of Ra1/Ra2≧1.3 is satisfied.

<a-Si Photosensitive Member Film Forming Apparatus According to Invention>

Figure 8:
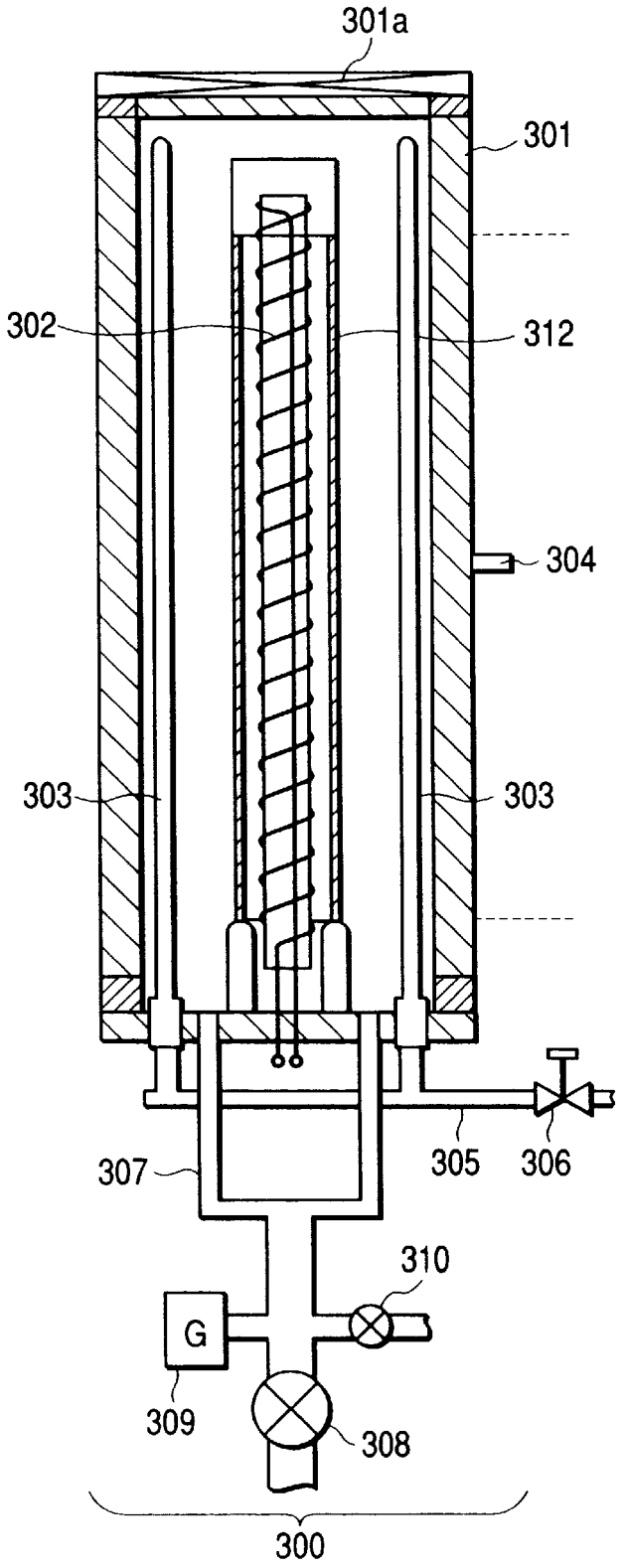
FIG. 8 is a schematic sectional view of a film forming apparatus that can be used for producing a photosensitive member.

An example of the a-Si photosensitive member film forming apparatus according to the present invention is shown in FIG. 8.

In the present invention, the photosensitive drum is an a-Si photosensitive member, whose a-Si photosensitive layer is formed by a high frequency plasma CVD (PCVD) method. The PCVD apparatus used in the present invention is illustrated in FIG. 8.

The apparatus shown in FIG. 8 is a common PCVD apparatus used in the manufacture of electro-photographic photosensitive members. This PCVD apparatus has a deposition apparatus 300, a source gas supplying apparatus and an exhaust apparatus (neither is shown).

The deposition apparatus 300 has a reaction vessel 301 consisting of a vertical vacuum vessel. At the inner periphery of this reaction vessel 301 are provided a plurality of vertically extending source gas introducing pipes 303, and the side surfaces of the source gas introducing pipes 303 have many pores provided along the lengthwise direction. At the center in the reaction vessel 301 is extended a coiled heater 302 in the vertical direction, and a cylinder 312 constituting the substrate of the photosensitive member drum 1 is inserted, with an upper lid 301*a* within the reaction vessel 301 opened, and installed vertically into the reaction vessel 301 to hold the heater 302 inside thereof. A high frequency power is supplied from a protruded portion 304 provided on one of the side surfaces of the reaction vessel 301.

To the lower portion of the reaction vessel 301 is attached a source gas supply pipe 305 connected to the source gas introducing pipes 303, and to this supply pipe 305 is connected a gas supply unit (not shown) via a supply valve 306. An exhaust pipe 307 is attached to the lower portion of the reaction vessel 301, and this exhaust pipe 307 is connected to an exhaust unit (vacuum pump, not shown) via a main exhaust valve 308. The exhaust pipe 307 is also provided with a vacuum gauge 309 and a sub-exhaust valve 310.

Formation of an a-Si photosensitive layer using the above-described apparatus by the PCVD method is accomplished in the following manner. First, the cylinder 312 constituting the substrate of the photosensitive member drum 1 is set in the reaction vessel 301, and after the lid 301*a* is closed, the inside of the reaction vessel 301 is exhausted by an exhaust unit (not shown) to a pressure not higher than a predetermined low level. While continuing exhaustion thereafter, the inside of the substrate 312 is heated by the heater 302 to control the temperature of the substrate 312 at a predetermined temperature within the range of 20° C. to 450° C.

When the substrate 312 is kept at the predetermined temperature, desired source gases are introduced via the introducing pipes 303 into the reaction vessel 301, while the flow rate controller (not shown) for each gas is adjusted. The introduced source gases, after filling the reaction vessel 301, are discharged out of the reaction vessel 301 via the exhaust pipe 307.

When it is confirmed on the vacuum gauge 309 that the inside of the reaction vessel 301 as filled with the source gases has stabilized at the predetermined pressure, high frequency of a desired power is introduced into the reaction vessel 301 from a high frequency power source (13.56 MHz in the RF band, 50 to 150 MHz of the VHF band or the like; not shown) to generate a glow discharge in the reaction vessel 301. The energy of the glow discharge decomposes the components of the source gases to generate plasma ions, so that an a-Si deposited layer mainly composed of silicon is formed on the surface of the substrate 312. At this time, by adjusting such parameters as types of gases, gas introducing rates, gas introducing rate ratio, pressure, substrate temperature, input power and film thickness to form a-Si deposited layers of various characteristics, it is possible to control the electrophotographic characteristics as intended.

After the a-Si deposited layer is formed on the surface of the substrate 312 in a desired film thickness, the supply of the high frequency power is stopped, the supply valve 306 and the like are closed to stop the introduction of the source gases into the reaction vessel 301, and the formation of the one a-Si deposited layer is thereby completed. By repeating the same operation a plurality of times, an a-Si deposited layer of a desired multilayer structure, i.e., an a-Si photosensitive layer is formed, resulting in the production of a photosensitive member drum 1 having the multilayer structure a-Si photosensitive layer on the surface of the substrate 312.

Alternatively, instead of stopping the high frequency power supply and the source gas supply when completing the formation of the one a-Si deposited layer, the power and gas supply can may be varied continuously to the power conditions and gas composition for the subsequent layer, or though the power supply is temporarily suspended, the supply of source gases is begun with the composition for the previous layer and the gas composition may be continuously varied to a new desired one for the film formation of the subsequent layer, making it possible to control reflection at the interface between the surface protective layer and the photoconductive layer.

In the above-described procedure, by adjusting the flow rate distribution in the lengthwise direction of the introducing pipes 303 of the source gases introduced into the reaction vessel 301 through the pores distributed along the lengthwise direction of the gas introducing pipes 303, the discharge rate of the exhaust gas through the exhaust pipe and the discharging energy, the electrophotographic characteristics in the lengthwise direction of the a-Si deposited layer on the substrate 312 can be controlled.

<Electrophotographic Apparatus According to Present Invention>

An example of an electrophotographic apparatus according to the present invention, using the electrophotographic photosensitive member fabricated as described above, is illustrated in FIG. 9. Incidentally, while the apparatus of this example is suitable where a cylindrical electrophotographic photosensitive member is to be used, the electrophotographic apparatus according to the present invention is not limited to this example, but the shape of the photosensitive member may be any desired one, such as endless belt-like shape or the like.

Figure 9:
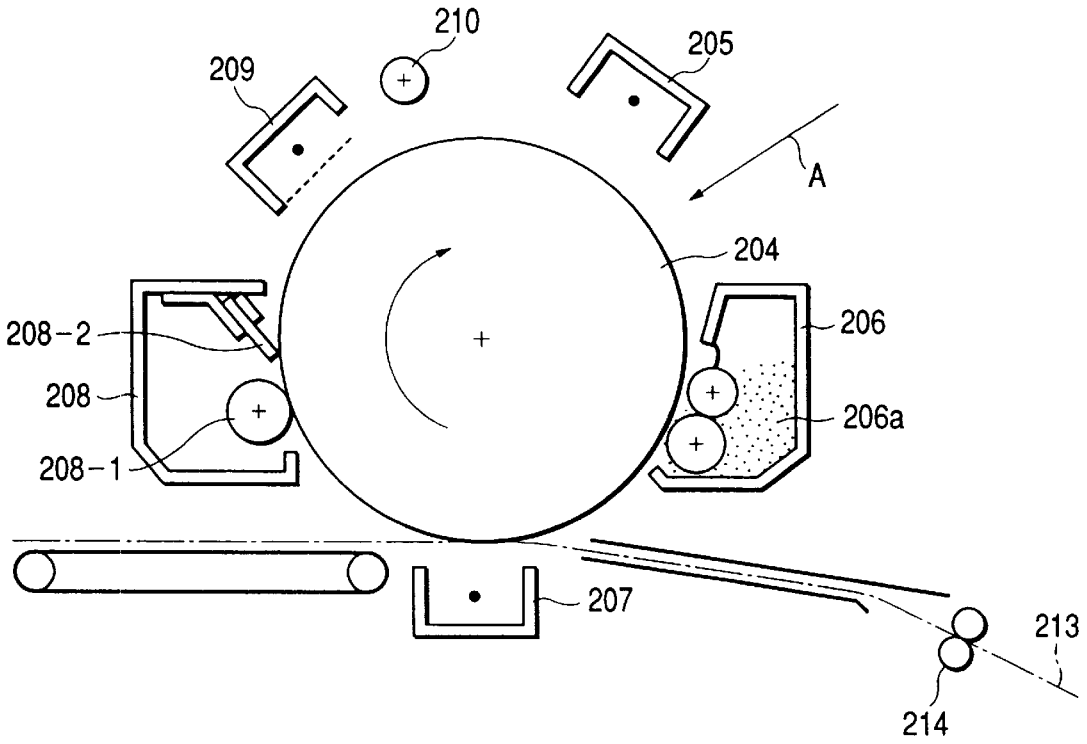
FIG. 9 is a schematic sectional view of an example of the configuration of an electrophotographic apparatus.

In FIG. 9, reference numeral 204 denotes an electrophotographic photosensitive member; 205 a primary charger for charging the photosensitive member 204 to form an electrostatic latent image; 206 a developing unit for supplying a developer (toner) to the photosensitive member 204 having the electrostatic latent image formed therein; and 207 a transfer charger for transferring the toner on the surface of the photosensitive member to a transfer sheet (recording medium).

Reference numeral 208 denotes a cleaner for cleaning the surface of the photosensitive member. In this example, in order to effectively accomplish uniform scraping of the surface of the photosensitive member, an elastic roller 208-1 and a cleaning blade 208-2 are used for cleaning the surface of the photosensitive member as described above, but the use of either one alone will do.

Reference numerals 209 and 210 respectively denote an AC decharger and a decharging lamp for decharging the surface of the photosensitive member in preparation for the next copying operation; 213 a transfer sheet of paper or the like; and 214 feed rollers for the transfer sheet. As the light source for exposure A, a halogen light source or a light source for mainly emitting a single wavelength light is used.

Using the apparatus, formation of a copied image is accomplished in the following manner, for instance. First, the electrophotographic photosensitive member 204 is rotated in the direction of the arrow at a predetermined speed, and the surface of the photosensitive member 204 is uniformly charged using the primary charger 205. Then, the exposure A with an image is effected on the charged surface of the photosensitive member 204 to form an electrostatic latent image of the image on the surface of the photosensitive member 204. Then, when the part of the surface of the photosensitive member 204 having the electrostatic latent image formed therein passes the part where the developing unit 206 is installed, a toner is supplied by the developing unit 206 to the surface of the photosensitive member 204 to make visible (develop) the electrostatic latent image into an image formed of toner 206*a*, and this toner image reaches the part where the transfer charger 207 is installed, by the rotation of the photosensitive member 204, where it is transferred to the transfer sheet 213 fed by the feed rollers 214.

After the completion of the transfer, to prepare for the next copying step, the remaining toner is removed from the surface of the electrophotographic photosensitive member 204 by the cleaner 208, and the surface is decharged by the decharger 209 and the decharging lamp 210 to bring the surface potential into zero or almost zero, thus completing one copying step.

<Surface Polishing Apparatus for Electrophotographic Photosensitive Member According to Present Invention>

Figure 10:
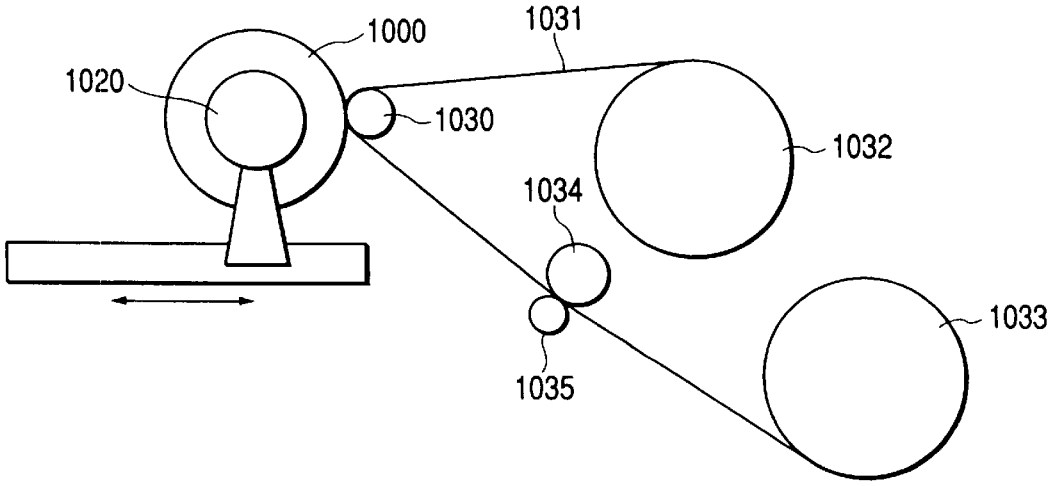
FIG. 10 is a schematic sectional view explaining an example of a surface polishing apparatus.

In FIG. 10, reference numeral 1000 denotes an a-Si photosensitive member; 1020 an elastic supporting mechanism, specifically a pneumatic holder (in this experiment, pneumatic holder, AIRPICK (trade name), model number: PO45TCA*820 mfd. by BRIDGESTONE CORP. was used); 1030 a pressure elastic roller for winding a polishing tape 1031 to bring the tape into pressure-contact with the a-Si photosensitive member 1000; 1032 a supply roll; 1033 a take-up roll; and 1034 and 1035 a constant rate supply roll and a capstan roller, respectively.

The polishing tape 1031 is preferably what is commonly called as a lapping tape, and abrasive grains of SiC, $Al_2O_3$, $Fe_2O_3$ or the like are preferably used. In this experiment, lapping tape LT-C2000 (trade name; mfd. by Fuji Photo Film Co., Ltd.) was used.

The pressure elastic roller 1030 is made of a material such as neoprene rubber, silicon rubber or the like, and its hardness in terms of JIS rubber hardness is preferably 20 to 80, more preferably 30 to 40. The roller preferably has a shape having a greater diameter in the middle than at both ends, wherein the difference in diameter is preferably 0.0 to 0.6 mm, more preferably 0.2 to 0.4 mm. The surface of the photosensitive member is polished by supplying the lapping tape while pressing the roller 1030 against the rotating photosensitive member 1000 with a force of 0.5 kg to 2.0 kg.

<Experiments>

The present invention will be described in further detail on the basis of various experiments.

Experiment 1

Effect of Elimination of Parallelization

By using the aforementioned a-Si photosensitive member film forming apparatus and shifting the parameters for the substrate shape and the production conditions, electrophotographic photosensitive member Nos. 101 to 113 were produced, with their Ra1/Ra2 varied from 1.05 to 1.40, Ra1 varied from 20 to 130 nm and the film thickness of the photoconductive layer varied from 15 to 60 μm.

A cylindrical substrate made of Al was used as the conductive substrate, which was subjected to various ways of surface machining including cutting and dimpling. However, in order to clearly determining the effect of the production conditions to control the fine roughness and to minimize the occurrence of image defects, cutting and cleaning were carried out so as to keep the surface roughness Ra within the range of 10 μm×10 μm range of the conductive substrate below 10 nm.

The values of Ra1/Ra22, Ra1 and the reflectance ratio of (Max−Min)/(Max+Min) of Min and Max of the reflectance (%) within the wavelength range of 600 nm to 700 nm, and the results of image evaluation are shown in Table 1.

The image evaluation was carried out by effecting endurance printing of 1 million sheets with a test pattern with a lower-than-usual printing percentage of 1%, using Canon's GP605 (trade name; pre-exposure: 700 nm LED array; image exposure: 675 nm laser; processing speed: 300 mm/sec), periodically outputting a halftone image, and effecting sensor evaluation for the uniformity and coarseness of the halftone images.

The evaluation marks in Table 1 have the following meanings respectively: ◎: Excellent; ○: Practically acceptable; x: Possibly posing practical problem.

The results shown in Table 1 reveal that the combination of Ra1/Ra2≧1.3 and 22 nm≦Ra1≦100 nm and (Max−Min)/(Max+Min)≦0.20 is preferable.

Experiment 2

Effect of Polishing

By using the aforementioned a-Si photosensitive member film forming apparatus and shifting the parameters for the substrate shape and the production conditions, electrophotographic photosensitive member Nos. 201 to 208 were produced with their Ra1/Ra22, Ra1 and reflectance ratio varied. The film thickness of the photoconductive layer was kept constant at 30 μm.

The conductive substrate was cut and cleaned so as to give the surface roughness Ra within the range of 10 μm×10 μm below 10 nm.

Figure 1:
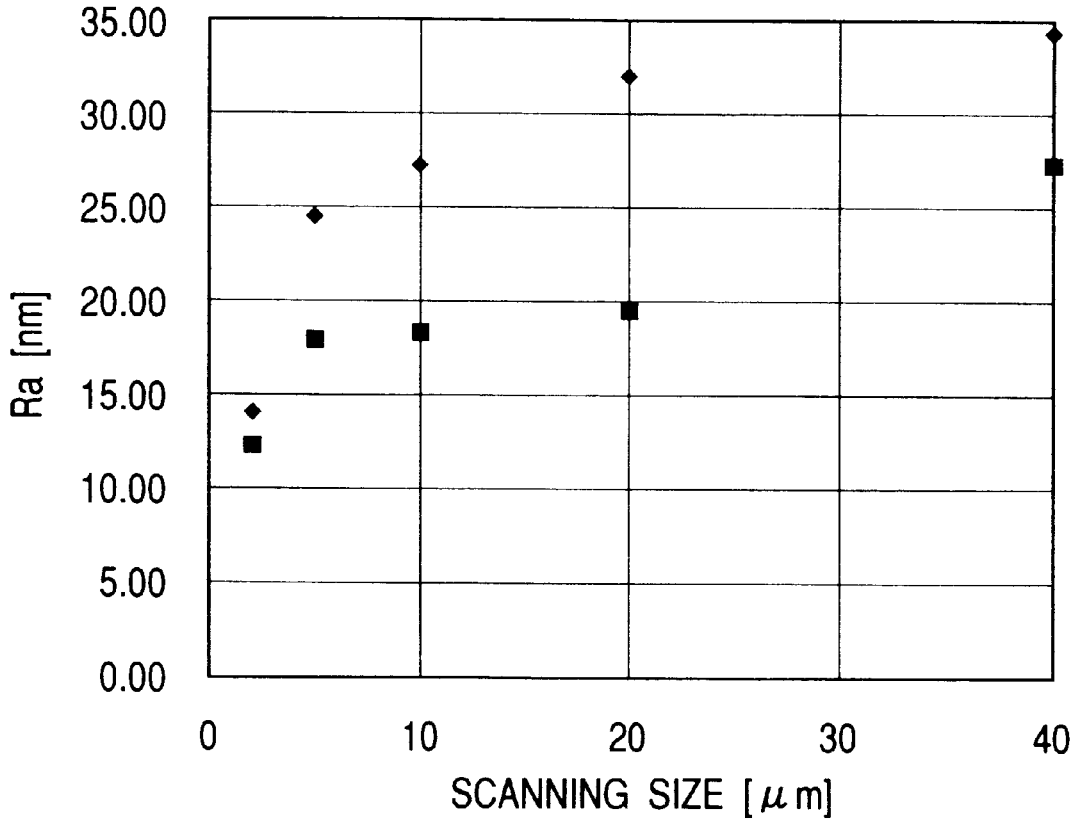
FIG. 1 is a diagram explaining the range of measurement of an AFM.
Figure 2:
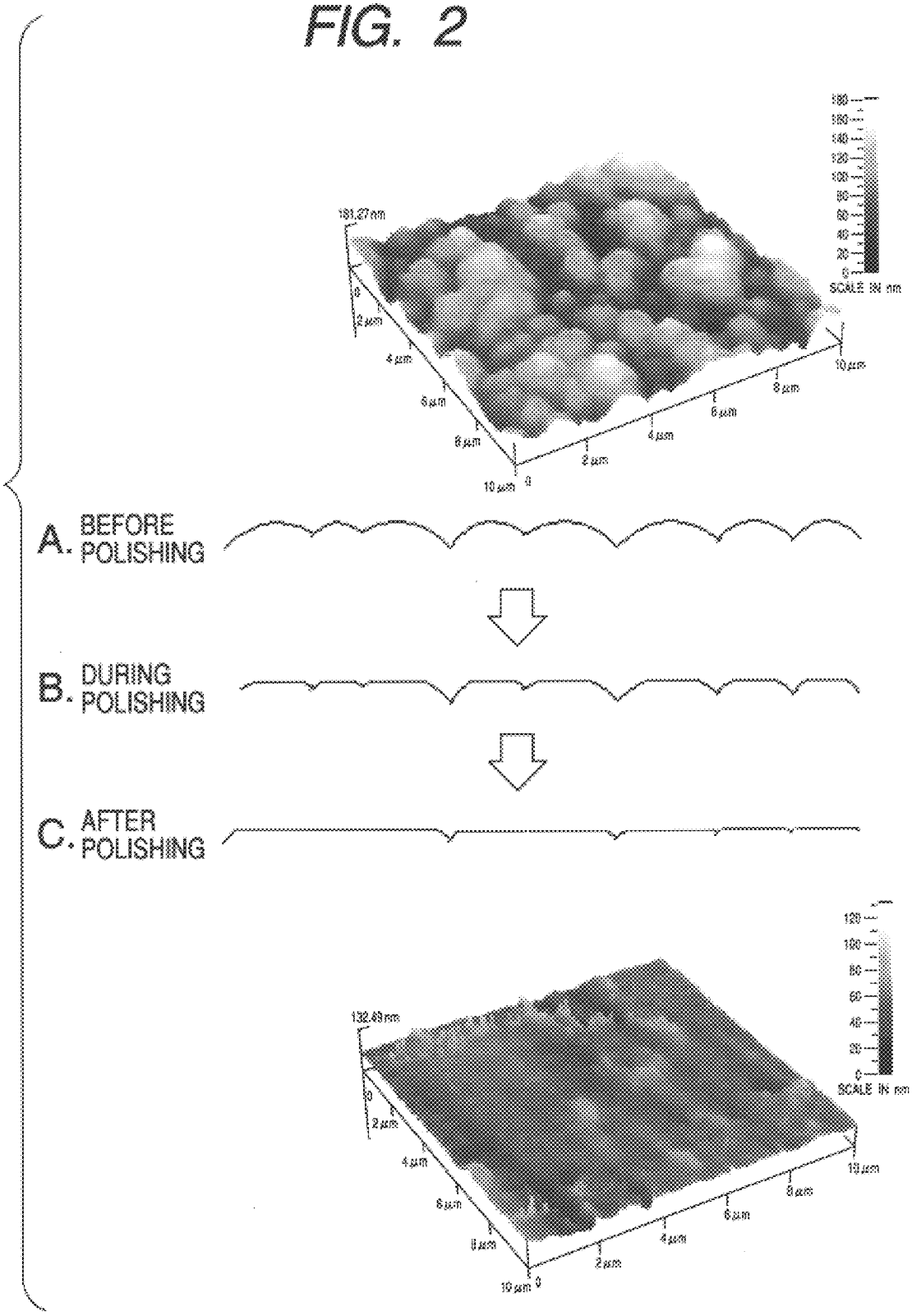
FIG. 2 is a view illustrating an example of the surface state of a conductive substrate based on an image observed with an atomic force microscope of the substrate.
Figure 3A:
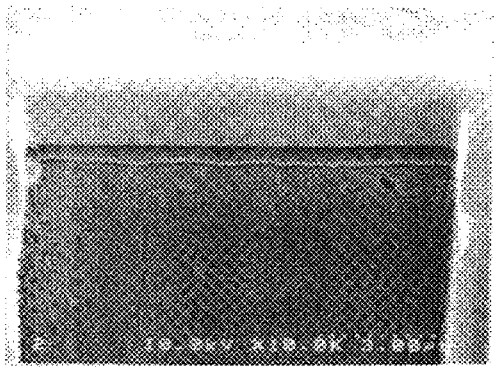
FIGS. 3A and 4A are views each illustrating an example of an image observed with a field emission type scanning electron microscope (FE-SEM)
Figure 3B:
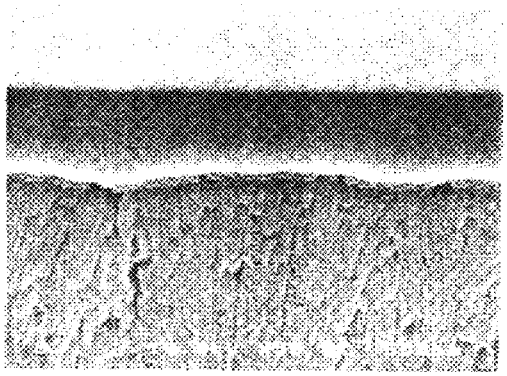
FIGS. 3B and 4B are enlarged views each illustrating a portion near the boundary of the layers shown in FIGS. 3A and 4A, respectively.
Figure 3C:
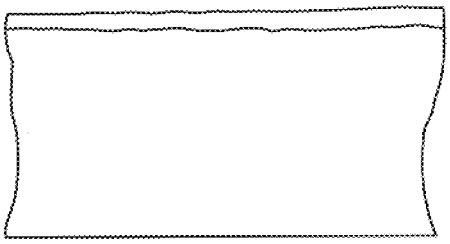
FIGS. 3C, 3D, 4C and 4D are views more clearly illustrating the outline of the layers shown in FIGS. 3A, 3B, 4A and 4B, respectively.
Figure 3D:
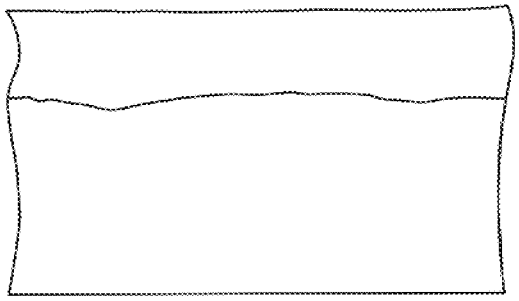
Figure 4A:
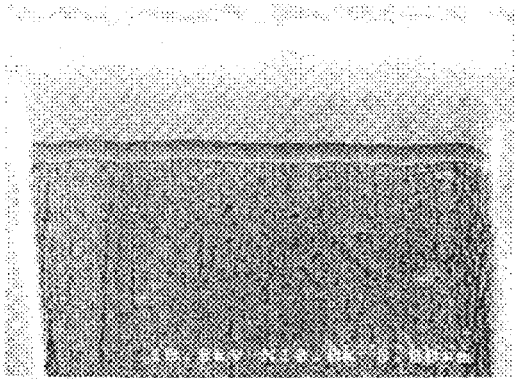
Figure 4B:
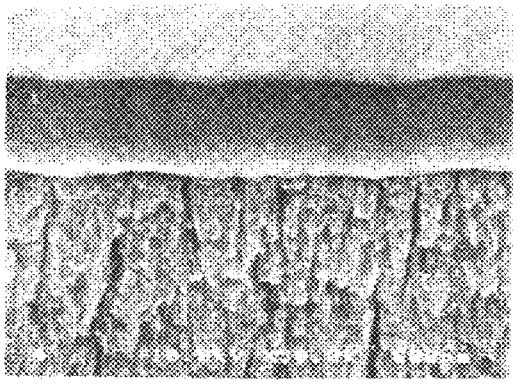
Figure 4C:
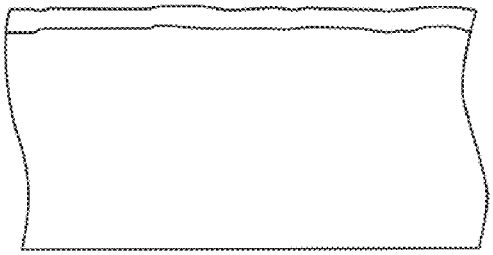
Figure 4D:
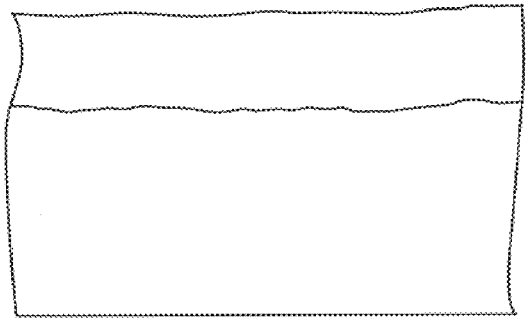
Figure 6A:
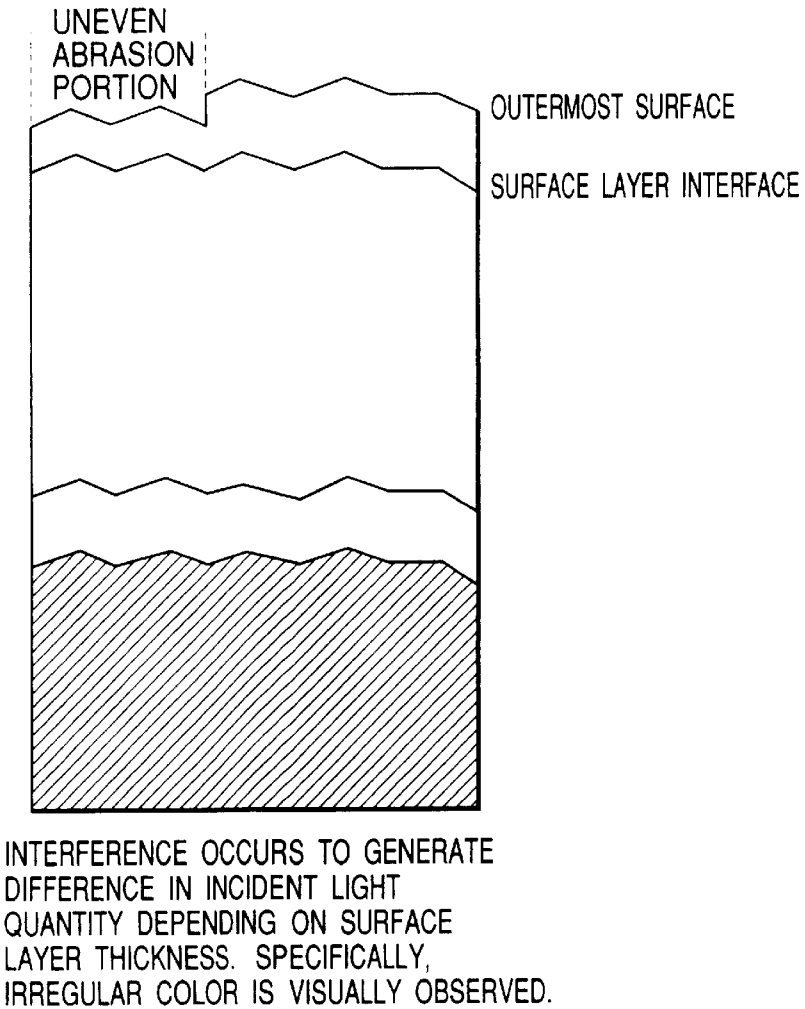
FIGS. 6A and 6B are schematic sectional views illustrating the phenomenon that uneven abrasion of a surface protective layer gives rise to an image density difference.
Figure 6B:
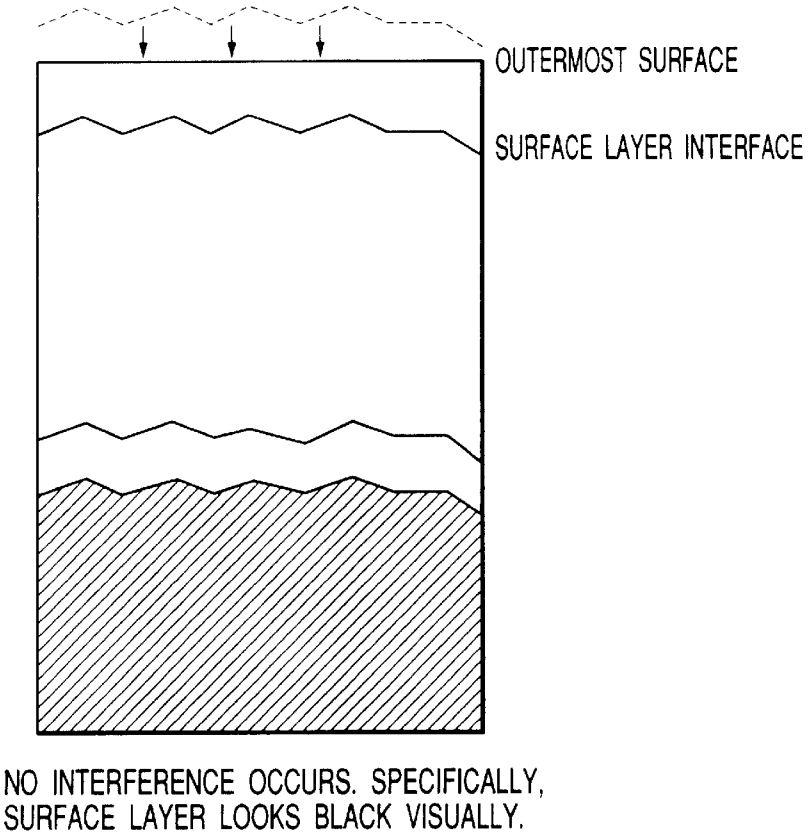

Then, a polishing apparatus such as illustrated in FIG. 10 was used to polish the outermost surface of the surface layer of the photosensitive member subjected to the film formation which corresponds to Ra2 in the present invention. An example of the results is shown in FIG. 2. The roughness of the outermost surface was gradually polished from the initial Ra of about 40 nm and smoothed to the Ra level of about 10 nm. Since the roughness of the surface side interface of the photoconductive layer, which corresponds to Ra1 in the present invention remains unchanged during the polishing, the value of Ra1/Ra2 increases. At this time, the layered configuration takes on the pattern such as shown in FIG. 6B, and the surface layer looks blackish visually.

The values of Ra1/Ra2, Ra1 and the reflectance ratio of (Max−Min)/(Max+Min) of Min and Max of the reflectance (%) within the wavelength range of 600 nm to 700 nm, and the results of image evaluation are shown in Table 2.

The image evaluation was carried out by effecting endurance printing of 1 million sheets with a test pattern with a lower-than-usual printing percentage of 1%, using Canon's GP605 (trade name; pre-exposure: 700 nm LED array; image exposure: 675 nm laser; processing speed: 300 mm/sec), periodically outputting a halftone image, and evaluating the uniformity (linear unevenness and interference fringes) of the halftone images. The sharpness of a digital image was evaluated by forming a pattern within the ranges of 60 to 500 μm in line width and 60 to 500 μm in line spacing and determining the degree of the reproducibility.

The evaluation marks in Table 2 have the following meanings respectively: ◎: Excellent; ○: Practically acceptable; x: Possibly posing practical problem.

The results shown in Table 2 reveal that the combination of Ra1/Ra2≧1.3, more preferably Ra1/Ra2≧1.5, and 22 nm≦Ra1≦100 nm and (Max−Min)/(Max+Min)≦0.20 is preferable.

Experiment 3

Effect of Surface Layer Material

After the layers up to and including the photoconductive layer were formed under the same conditions, electrophotographic photosensitive member Nos. 301 to 306 were produced with their Ra1/Ra2 and Ra1 varied by following the same procedure as Experiments 1 and 2 with the exception that the material for the surface layer was a-SiC:H for Nos. 301 to 303 and a-C:H for Nos. 304 to 306. The film thickness of the photoconductive layer was kept constant at 30 μm.

The conductive substrate was cut and cleaned so as to give the surface roughness Ra within the range of 10 μm×10 μm below 10 nm.

The values of Ra1/Ra2 and Ra1 and the results of image evaluation are shown in Table 3.

The image evaluation was carried out by effecting endurance printing of 1 million sheets with a test pattern with a lower-than-usual printing percentage of 1%, using Canon's GP605 (trade name; pre-exposure: 700 nm LED array; image exposure: 675 nm laser; processing speed: 300 mm/sec), periodically outputting a halftone image, and evaluating the uniformity of the halftone images. The sharpness of a digital image was evaluated by forming a pattern within the ranges of 60 to 500 μm in line width and 60 to 500 μm in line spacing and determining the degree of the reproducibility.

The evaluation marks in Table 3 have the following meanings respectively: ◎: Excellent; ○: Practically acceptable; x: Possibly posing practical problem.

The results shown in Table 3 reveal that the use as the outermost layer of the layer consisting of amorphous carbon containing hydrogen additional provides the effect of covering and flattening, which facilitates achievement of the condition of Ra1/Ra2≧1.3, thus providing the satisfactory results.

EXAMPLES

The present invention will be further described below with reference to examples thereof and comparative examples.

Example 1

By using the aforementioned a-Si photosensitive member film forming apparatus and shifting the parameters for the shape of a ϕ108 mirror-finished substrate and the production conditions, an electrophotographic photosensitive member of Ra1/Ra2=2.00, Ra1=40 nm, and 30 μm in film thickness of the photoconductive layer was produced. The (Max−Min)/(Max+Min) of the reflectance was 0.05.

The values of Ra1/Ra2 and Ra1 and the results of image evaluation of this photosensitive member are shown in Table 4.

The image evaluation was carried out by effecting endurance printing of 5 million sheets using Canon's GP605 (trade name; pre-exposure: 700 nm LED array; image exposure: 675 nm laser; processing speed: 300 mm/sec), evaluating the uniformity (linear unevenness and interference fringes) of the halftone image and the sharpness of a digital image, and overall evaluation was effected based on the results thereof.

The evaluation marks in Table 4 have the following meanings respectively: ◎: Excellent; ○: Practically acceptable; x: Possibly posing practical problem.

Figure 5A:
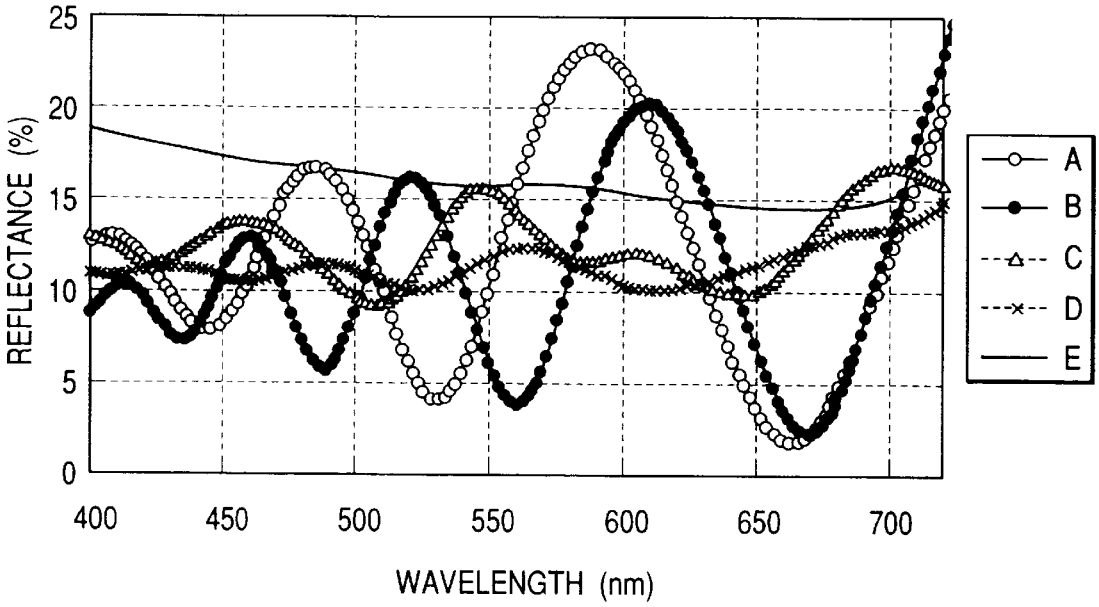
FIGS. 5A and 5B are diagrams explaining the control of reflection at the interface of the photoconductive layer and the surface layer.
Figure 5B:
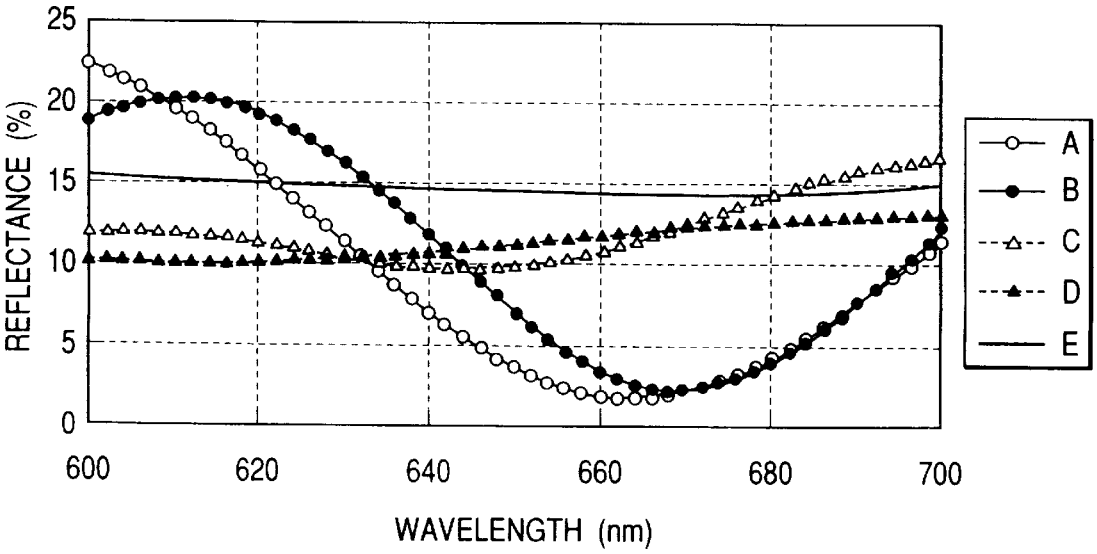

Sectionally observed images of the surface layer portion, measured by FE-SEM observation of the photosensitive member produced in Example 1 are shown in FIGS. 3A to 3D, and its spectral reflection data are shown by E in FIG. 5B.

Example 2

An electrophotographic photosensitive member produced by using the aforementioned a-Si photosensitive member film forming apparatus and shifting the parameters for the shape of a ϕ108 mirror-finished substrate and the production conditions was polished using the polishing apparatus such as shown in FIG. 10 to provided an electro-photographic photosensitive member of Ra1/Ra2=2.85, Ra1=50 nm and 30 μm in film thickness of the photoconductive layer was obtained. The (Max−Min)/(Max+Min) of the reflectance was 0.03.

The values of Ra1/Ra2 and Ra1 and the results of image evaluation of this photosensitive member, evaluated in the same manner as Example 1, are shown in Table 4.

Example 3

By using the aforementioned a-Si photosensitive member film forming apparatus and shifting the parameters for the shape of a ϕ108 mirror-finished substrate and the production conditions in the same manner as Example 1 except that a-C:H was used as the material for the surface layer, an electrophotographic photosensitive member of Ra1/Ra2=3.00, Ra1=70 nm and 30 μm in film thickness of the photoconductive layer was produced. The (Max−Min)/(Max+Min) of the reflectance was 0.02.

The values of Ra1/Ra2 and Ra1 and the results of image evaluation of this photosensitive member, evaluated in the same manner as Example 1, are shown in Table 4.

Example 4

An electrophotographic photosensitive member produced by using the aforementioned a-Si photosensitive member film forming apparatus and shifting the parameters for the shape of a ϕ108 mirror-finished substrate and the production conditions was polished using the polishing apparatus such as shown in FIG. 10 to provided an electro-photographic photosensitive member of Ra1/Ra2=1.50, Ra1=70 nm and 15 μm in film thickness of the photoconductive layer was obtained. The (Max−Min)/(Max+Min) of the reflectance was 0.12.

The values of Ra1/Ra2 and Ra1 and the results of image evaluation of this photosensitive member, evaluated in the same manner as Example 1, are shown in Table 4.

Comparative Example 1

By using the aforementioned a-Si photosensitive member film forming apparatus and shifting the parameters for the shape of a ϕ108 mirror-finished substrate and the production conditions, an electrophotographic photosensitive member of Ra1/Ra2=1.25, Ra1=50 nm and 30 μm in film thickness of the photoconductive layer was produced. The (Max−Min)/(Max+Min) of the reflectance was 0.22.

The values of Ra1/Ra2 and Ra1 and the results of image evaluation of this photosensitive member, evaluated in the same manner as Example 1, are shown in Table 4.

Sectionally observed images of the surface layer portion, measured by FE-SEM observation of the photosensitive member produced in Comparative Example 1 are shown in FIGS. 4A to 4D, and its spectral reflection data are represented by C in FIG. 5B.

Comparative Example 2

By using the aforementioned a-Si photosensitive member film forming apparatus and shifting the parameters for the shape of a ϕ108 mirror-finished substrate and the production conditions, an electrophotographic photosensitive member of Ra1/Ra2=1.40, Ra1=120 nm and 30 μm in film thickness of the photoconductive layer was produced. The (Max−Min)/(Max+Min) of the reflectance was 0.10.

The values of Ra1/Ra2 and Ra1 and the results of image evaluation of this photosensitive member, evaluated in the same manner as Example 1, are shown in Table 4.

Example 5

By using the aforementioned a-Si photosensitive member film forming apparatus and shifting the parameters for the shape of a ϕ30 mirror-finished substrate and the production conditions, an electrophotographic photosensitive member of Ra1/Ra2=1.50 and Ra1=70 nm was produced. The (Max−Min)/(Max+Min) of the reflectance was 0.10.

The values of Ra1/Ra2 and Ra1 and the results of image evaluation of this photosensitive member are shown in Table 5.

The image evaluation was carried out by effecting endurance printing of one million sheets using Canon's GP405 (trade name), evaluating the uniformity of a halftone image and the sharpness of a digital image, and overall evaluation was effected based on the results thereof.

The evaluation marks in Table 5 have the following meanings respectively: *: Very excellent; ⊙: Excellent; ○: Practically acceptable; x: Possibly posing practical problem.

Comparative Example 3

By using the aforementioned a-Si photosensitive member film forming apparatus and shifting the parameters for the shape of a φ30 mirror-finished substrate and the production conditions, an electrophotographic photosensitive member of Ra1/Ra2=1.10 and Ra1=10 nm was produced. The (Max−Min)/(Max+Min) of the reflectance was 0.60.

The values of Ra1/Ra2 and Ra1 and the results of image evaluation of this photosensitive member are shown in Table 5.

The image evaluation was carried out by effecting endurance printing of one million sheets using Canon's GP405 (trade name), evaluating the uniformity of a halftone image and the sharpness of a digital image, and overall evaluation was effected based on the results thereof.

The evaluation marks in Table 5 have the following meanings respectively: *: Very excellent; ⊙: Excellent; ○: Practically acceptable; x: Possibly posing practical problem.

As described above, according to the electrophotographic photosensitive member and electro-photographic apparatus according to the present invention, by providing a photosensitive member formed by successively stacking on a conductive substrate a photoconductive layer comprising amorphous Si and a surface protective layer comprised of an amorphous material, wherein the Min and Max of the reflectance (%) of the photosensitive member within the wavelength range of 600 nm to 700 nm satisfy the relation of 0≦(Max−Min)/(Max+Min)≦0.20, and a center line average roughness Ra1 of the interface on the surface side of the photoconductive layer and a center line average roughness Ra2 of the outermost surface of the surface layer, within the range of 10 μm×10 μm, satisfy the relations of Ra1/Ra2≧1.3 and 22 nm≦Ra1≦100 nm, it has become possible to prevent the fusion bonding of a toner during cleaning and thereby to maintain satisfactory quality of a halftone image, without continuously varying the interface composition. Further, since no control to suppress the reflection at interfaces is required, there is the additional advantage that strict control of manufacturing conditions for steady production is unnecessary.

In addition, by controlling the thickness of the photoconductive layer to be 14 to 50 μm, interference between the substrate and the Ra1 surface is prevented, and it is made possible to minimize the possibility of occurrence of film peeling off, increase of image defects and increase of production cost.

Moreover, the use as the outermost layer of the layer comprised of amorphous carbon containing hydrogen additional provides the effect of covering and flattening, which facilitates achievement of the condition of Ra1/Ra2≧1.3, thus easily providing the satisfactory results.

TABLE 1

| | | | | | Image evaluation | | |
|---|---|---|---|---|---|---|---|
| | Ra1/Ra2 | Ra1 [nm] | Reflectance ratio | Film thickness [μm] | Linear unevenness in halftone | Coarse-ness | Interference fringes |
| 101 | 1.05 | 20 | 0.60 | 30 | × | ⊙ | ⊙ |
| 102 | 1.05 | 50 | 0.40 | 30 | × | ⊙ | ⊙ |
| 103 | 1.11 | 50 | 0.35 | 30 | × | ⊙ | ⊙ |
| 104 | 1.20 | 50 | 0.30 | 30 | × | ⊙ | ⊙ |
| 105 | 1.31 | 20 | 0.25 | 30 | × | ⊙ | ⊙ |
| 106 | 1.31 | 50 | 0.18 | 30 | ○ | ⊙ | ⊙ |
| 107 | 1.31 | 95 | 0.15 | 30 | ○ | ○ | ⊙ |
| 108 | 1.40 | 95 | 0.11 | 30 | ⊙ | ○ | ⊙ |
| 109 | 1.40 | 110 | 0.10 | 30 | ⊙ | × | ⊙ |
| 110 | 1.40 | 130 | 0.09 | 30 | ⊙ | × | ⊙ |
| 111 | 1.40 | 70 | 0.12 | 15 | ⊙ | ○ | ○ |
| 112 | 1.40 | 70 | 0.12 | 30 | ⊙ | ○ | ⊙ |
| 113 | 1.40 | 70 | 0.12 | 60 | ⊙ | ○ | ⊙ |
| Machines for evaluation | Quesant's AFM and Hitachi's S-4200 type FE-SEM | | | | Canon's GP605 | | |

TABLE 2

| | | | | Image evaluation | |
|---|---|---|---|---|---|
| | Ra1/Ra2 | Ra1 [nm] | Reflectance ratio | Linear uneven-ness in halftone | Digital image sharp-ness |
| 201 | 1.22 | 40 | 0.30 | × | ⊙ |
| 202 | 1.32 | 34 | 0.19 | ○ | ⊙ |
| 203 | 1.32 | 73 | 0.17 | ○ | ⊙ |
| 204 | 1.32 | 118 | 0.14 | ○ | × |
| 205 | 1.45 | 95 | 0.13 | ○ | ○ |
| 206 | 1.50 | 20 | 0.21 | × | ⊙ |
| 207 | 1.50 | 54 | 0.12 | ○ | ⊙ |
| 208 | 1.50 | 110 | 0.10 | ⊙ | × |
| Machines for evaluation | Quesant's AFM and Hitachi's S-4200 type FE-SEM | | | Canon's GP605 | |

TABLE 3

| | Ra1/Ra2 | Ra1 [nm] | Image evaluation: Linear unevenness in halftone | Image evaluation: Digital image sharpness |
|---|---|---|---|---|
| 301 | 1.19 | 22 | × | ◎ |
| 302 | 1.19 | 34 | × | ◎ |
| 303 | 1.19 | 54 | × | ◎ |
| 304 | 1.45 | 23 | ○ | ◎ |
| 305 | 1.45 | 34 | ○ | ◎ |
| 306 | 1.45 | 53 | ○ | ◎ |
| Machines for evaluation | Quesant's AFM and Hitachi's S-4200 type FE-SEM | | Canon's GP605 | |

TABLE 4

| | Ra1/Ra2 | Ra1 [nm] | Reflectance ratio | Film thickness [μm] | Image evaluation: Linear unevenness in halftone | Image evaluation: Digital image sharpness | Image evaluation: Interference fringes | Image evaluation: overall evaluation |
|---|---|---|---|---|---|---|---|---|
| Example 1 | 2.00 | 40 | 0.05 | 30 | ◎ | ◎ | ◎ | ◎ |
| Example 2 | 2.85 | 50 | 0.03 | 30 | ◎ | ◎ | ◎ | ◎ |
| Example 3 | 3.00 | 70 | 0.02 | 30 | ◎ | ○ | ◎ | ◎ |
| Example 4 | 1.50 | 70 | 0.12 | 15 | ◎ | ○ | ○ | ○ |
| Comparative Example 1 | 1.25 | 50 | 0.22 | 30 | × | ◎ | ◎ | × |
| Comparative Example 2 | 1.40 | 120 | 0.10 | 30 | ◎ | × | ◎ | × |
| Machines for evaluation | Quesant's AFM and Hitachi's S-4200 type FE-SEM | | | | Canon's GP605 | | | |

TABLE 5

| | Ra1/Ra2 | Ra1 [nm] | Reflectance ratio | Image evaluation: Linear unevenness in halftone | Image evaluation: Digital image sharpness | Image evaluation: Overall evaluation |
|---|---|---|---|---|---|---|
| Example 5 | 1.50 | 70 | 0.10 | * | ◎ | * |
| Comparative Example 3 | 1.10 | 10 | 0.60 | × | ◎ | × |
| Machines for evaluation | Quesant's AFM and Hitachi's S-4200 type FE-SEM | | | Canon's GP405 | | |

What is claimed is:

1. An electrophotographic photosensitive member formed by successively stacking on a conductive substrate a photoconductive layer comprising amorphous Si and a surface protective layer comprised of an amorphous material, wherein the minimum value (Min) and the maximum value (Max) of the reflectance (%) of the photosensitive member within the wavelength range of 600 nm to 700 nm satisfy the relation of $0 \leqq (Max-Min)/(Max+Min) \leqq 0.20$, and a center line average roughness Ra1 of an interface on the surface side of the photoconductive layer and a center line average roughness Ra2 of the outermost surface of the surface protective layer, within the range of 10 μm×10 μm, satisfy the relations of Ra1/Ra2≧1.3 and 22 nm≦Ra1≦100 nm.

2. The electrophotographic photosensitive member according to claim 1, wherein the photosensitive member has a polished surface.

3. The electrophotographic photosensitive member according to claim 2, wherein the surface roughness Ra within the range of 10 μm×10 μm of the conductive substrate is less than 10 nm.

4. The electrophotographic photosensitive member according to claim 1, comprising a layer comprised of amorphous carbon containing hydrogen on the outermost surface.

5. The electrophotographic photosensitive member according to claim 1, wherein the thickness of the photoconductive layer is 14 to 50 μm.

6. The electrophotographic photosensitive member according to claim 1, further comprising a lower blocking layer between the conductive substrate and the photoconductive layer.

7. The electrophotographic photosensitive member according to claim 6, wherein the lower blocking layer comprises a Group 13 element or Group 15 element.

8. The electrophotographic photosensitive member according to claim 1, further comprising an upper blocking layer between the photoconductive layer and the surface protective layer.

9. The electrophotographic photosensitive member according to claim 8, wherein the upper blocking layer comprises a Group 13 element or Group 15 element.

10. An electrophotographic apparatus comprising: an electrophotographic photosensitive member formed by successively stacking on a conductive substrate a photoconductive layer comprising amorphous Si and a surface protective layer comprised of an amorphous material, wherein the minimum value (Min) and the maximum value (Max) of the reflectance (%) of the photosensitive member within the wavelength range of 600 nm to 700 nm satisfy the relation of $0 \leqq (Max-Min)/(Max+Min) \leqq 0.20$, and a center line average roughness Ra1 of an interface on the surface side of the photoconductive layer and a center line average roughness Ra2 of the outermost surface of the surface protective layer, within the range of 10 μm×10 μm, satisfy the relations of Ra1/Ra2≧1.3 and 22 nm≦Ra1≦100 nm.

11. The electrophotographic apparatus according to claim 10, wherein the photosensitive member has a polished surface.

* * * * *